US008068628B2

(12) United States Patent
Ritter et al.

(10) Patent No.: US 8,068,628 B2
(45) Date of Patent: Nov. 29, 2011

(54) METHOD AND ARRANGEMENT FOR EXCHANGING DATA WITH A HEARING DEVICE

(75) Inventors: Hartmut Ritter, Neunkirchen am Brand (DE); Tom Weidner, Erlangen (DE)

(73) Assignee: Siemens Audiologische Technik GmbH

( * ) Notice: Subject to any disclaimer, the term of this patent is extended or adjusted under 35 U.S.C. 154(b) by 804 days.

(21) Appl. No.: 12/217,060

(22) Filed: Jul. 1, 2008

(65) Prior Publication Data

US 2009/0010467 A1 Jan. 8, 2009

(30) Foreign Application Priority Data

Jul. 6, 2007 (DE) ..... 10 2007 031 488

(51) Int. Cl.
*H04R 25/00* (2006.01)
*H04R 25/02* (2006.01)

(52) U.S. Cl. ..... 381/314; 381/320; 381/321; 381/323; 381/330

(58) Field of Classification Search ..... 381/314, 381/323, 324, 330, 60, 312, 315, 320, 321
See application file for complete search history.

(56) References Cited

U.S. PATENT DOCUMENTS

| | | | | |
|---|---|---|---|---|
| 5,027,410 | A * | 6/1991 | Williamson et al. | 381/320 |
| 5,404,407 | A * | 4/1995 | Weiss | 381/314 |
| 5,835,611 | A * | 11/1998 | Kaiser et al. | 381/321 |
| 6,044,164 | A * | 3/2000 | Ach-Kowalewski | 381/314 |
| 6,144,748 | A * | 11/2000 | Kerns | 381/312 |
| 6,556,686 | B1 * | 4/2003 | Weidner | 381/312 |
| 6,859,538 | B1 | 2/2005 | Voltz | |
| 2003/0128855 | A1 | 7/2003 | Moller | |
| 2006/0171550 | A1 * | 8/2006 | Bryant et al. | 381/330 |
| 2008/0137889 | A1 * | 6/2008 | Rass | 381/314 |

FOREIGN PATENT DOCUMENTS

| | | | |
|---|---|---|---|
| EP | 1 133 897 | B1 | 9/2001 |
| EP | 0638367 | A2 | 3/2006 |
| WO | 99/09799 | A2 | 3/1999 |

* cited by examiner

*Primary Examiner* — Allan R Wilson

(57) ABSTRACT

Data is exchanged between a hearing device and a connectable unit. The data, such as an identification code, may be read from the unit. Data may also be output to the connectable unit. The connectable unit may include a random access memory. Furthermore, the connectable unit may include a sequence control element.

10 Claims, 3 Drawing Sheets

METHOD AND ARRANGEMENT FOR EXCHANGING DATA WITH A HEARING DEVICE

CROSS REFERENCE TO RELATED APPLICATIONS

This application claims priority of German application No. 10 2007 031 488.6 DE filed Jul. 6, 2007, which is incorporated by reference herein in its entirety.

FIELD OF INVENTION

The invention relates to a method for exchanging data with a hearing device and an associated arrangement.

BACKGROUND OF INVENTION

Numerous hearing devices have the possibility to connect to different, external modules. By way of example, different audioshoes or radio transmitters can be connected to a behind-the-ear part of a hearing device. The presence of an external module is recognized by the hearing device alone, on connection of the two parts.

SUMMARY OF INVENTION

The object of the invention is to provide improved recognition of external hearing device modules.

According to the invention, the object set is achieved with a method and an apparatus by the features listed in the independent claims, by data being exchanged between a connected unit and a hearing device.

The invention is advantageous in that different connectable units are recognized in a reliable and fail-safe manner.

The invention is also advantageous in that the hearing device can provide or activate the operating parameters and signal processing algorithms which are required for the respective unit.

The invention is also advantageous in that data relating to the service life and/or frequency of use can be stored both in the hearing device and also in the unit.

The invention is also advantageous in that data can be selected in a time or event-controlled fashion.

It is further advantageous that units and hearing devices can be connected to a pairwise function, so that certain units can only be operated with certain hearing devices.

It is also advantageous for the units to be able to store protocol and diagnostic data from the hearing device and then to be able to transmit this data to a service control center for instance via a communications interface.

Further advantageous embodiments are specified in the dependent claims.

BRIEF DESCRIPTION OF THE DRAWINGS

Further characteristics of the invention are apparent from the descriptions of exemplary embodiments that follow on the basis of schematic drawings, in which.

DETAILED DESCRIPTION OF INVENTION

The invention specifies a method for exchanging data between a hearing device and connectable units. With the method, a hearing device is provided, a unit is selected, the unit is connected to the hearing device and it is detected whether a contact exists with the unit and an identification code is read out from said unit.

In a further embodiment, additional stored data is read out from the unit and/or data is output to the unit.

The invention also specifies an arrangement for exchanging data between a hearing device and at least one connectable unit. The unit is embodied such that it exchanges data with the hearing device when a contact is established with the hearing device or at predeterminable times following a contact having been established with the hearing device.

The unit can include a random access memory (RAM).

The unit can include a sequence control element.

The unit can include an electroacoustic converter.

Figure 1:
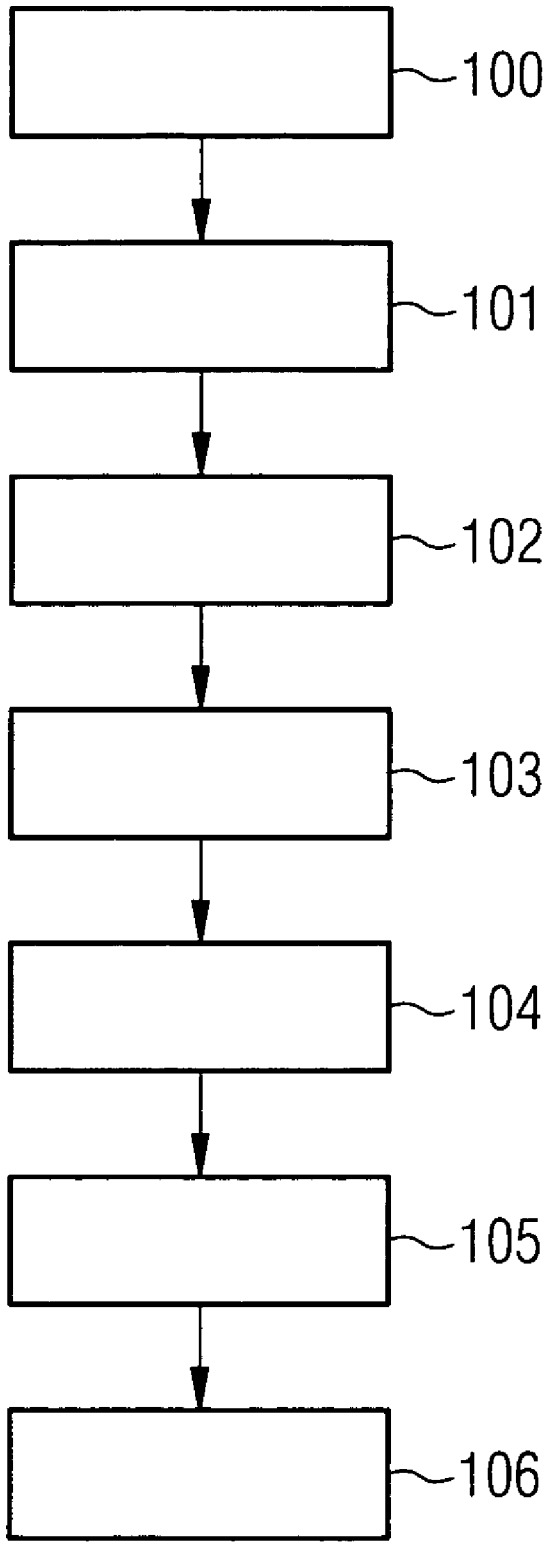
FIG. 1 shows a flow chart.

FIG. 1 reproduces an exemplary embodiment of the method according to the invention in the form of a flow chart. The method for exchanging data between a hearing device 2 and connectable units 1 includes the following steps. In step 100, a hearing device 2, which includes a behind-the-ear part and an in-the-ear part for instance, is provided. In the following step 101, a unit 1, for instance an audioshoe for connecting external audio devices, is selected and is connected to the hearing device 2 in step 102. Step 103 detects whether a contact exists between hearing device 2 and unit 1. In step 104, an identification code is finally read out from the unit 1. In steps 105, stored data, for instance the service life of unit 1, is read out from unit 1 and in subsequent step 106, data, for instance operating parameters, is output to the unit 1.

With this method, different units 1 are recognized in a reliable and fail-safe manner. Suitable operating parameters and signal processing algorithms can be provided or activated by the hearing device 2 for the respective unit 1. Data relating to the service life or frequency of use of the units 1 can likewise be exchanged. Units 1 can also be used in a time or event-controlled fashion. Units 1 and hearing devices 2 can be switched to a pairwise function in order to allow a certain unit 1 only to be operated with a certain hearing device. An effective anti-theft protection system can thus be provided. The units 1 can also store diagnosis and protocol data from the hearing device 2, which is then sent to a service control center 13 when the units 1 are connected to a computer by way of a network, for instance the internet. Separately sending the units 1 to a hearing device acoustician or a hearing device manufacturer is also possible. Software updates or releases of functions can be performed in the units 1 on the part of the hearing device manufacturer or hearing device acoustician.

Figure 2:
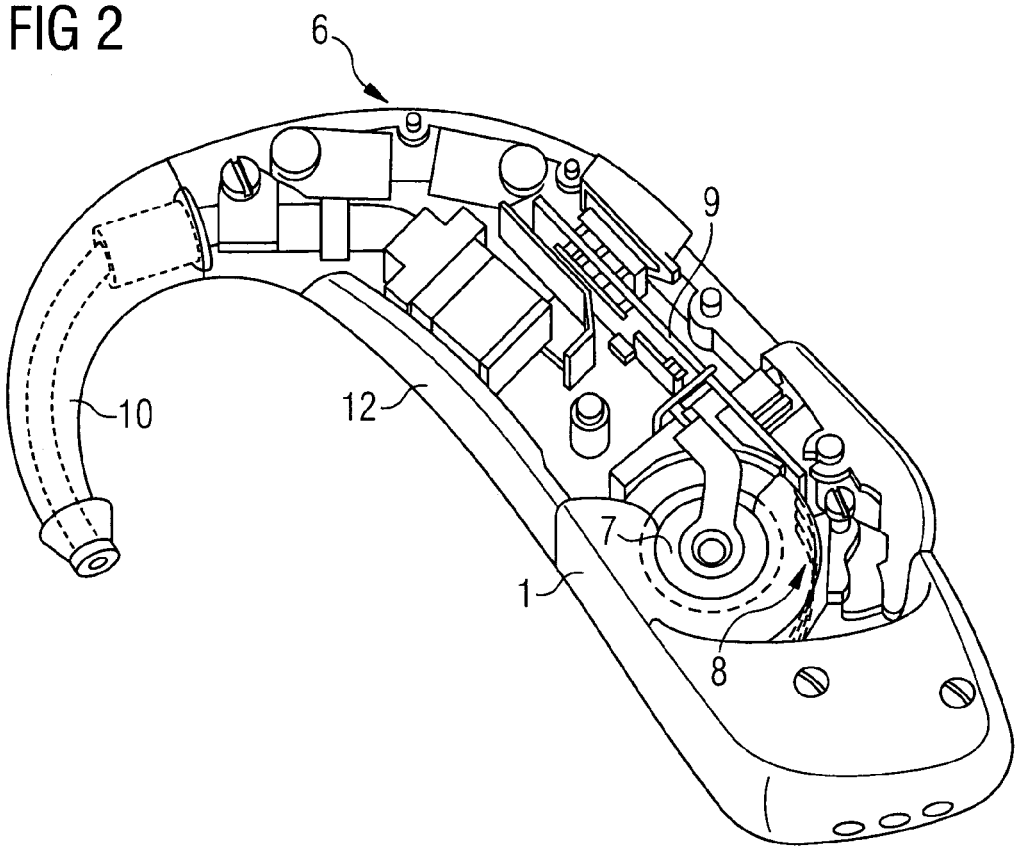
FIG. 2 shows a behind-the-ear part of a hearing device.

FIG. 2 shows a view of a behind-the-ear part 6 of a hearing device 2 with a connected unit 1, for instance a pluggable audioshoe and a base module 12. The behind-the-ear part 6 is equipped with the audioshoe 1 on the end facing away from the wearing hook 10. FIG. 2 also shows a battery 7 and a printed circuit board assembly 9. Contact springs 8 establish the electrical contact between the audioshoe 1 and the circuit board 9. The electronic components (not shown) for exchanging data between the behind-the-ear part 6 and the audioshoe 1 are attached inter alia on the circuit board 9.

Figure 3:
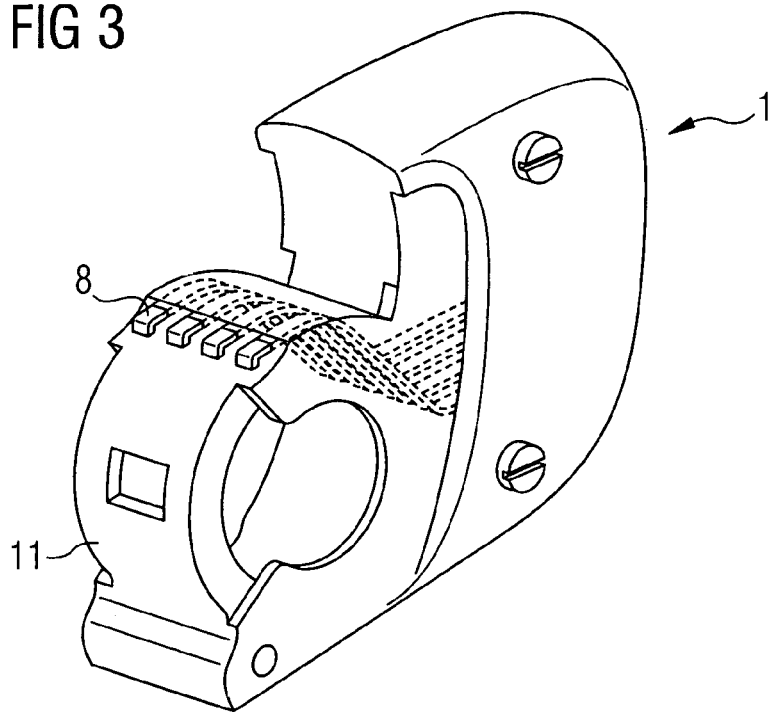
FIG. 3 shows an audioshoe.

FIG. 3 shows an enlarged view of the audioshoe 1 from FIG. 2 when in a removed state. The contact springs 8 and a battery retaining section 11 can be seen. An electronics system for storing data (not shown) is located in the housing of the audioshoe 1.

Figure 4:
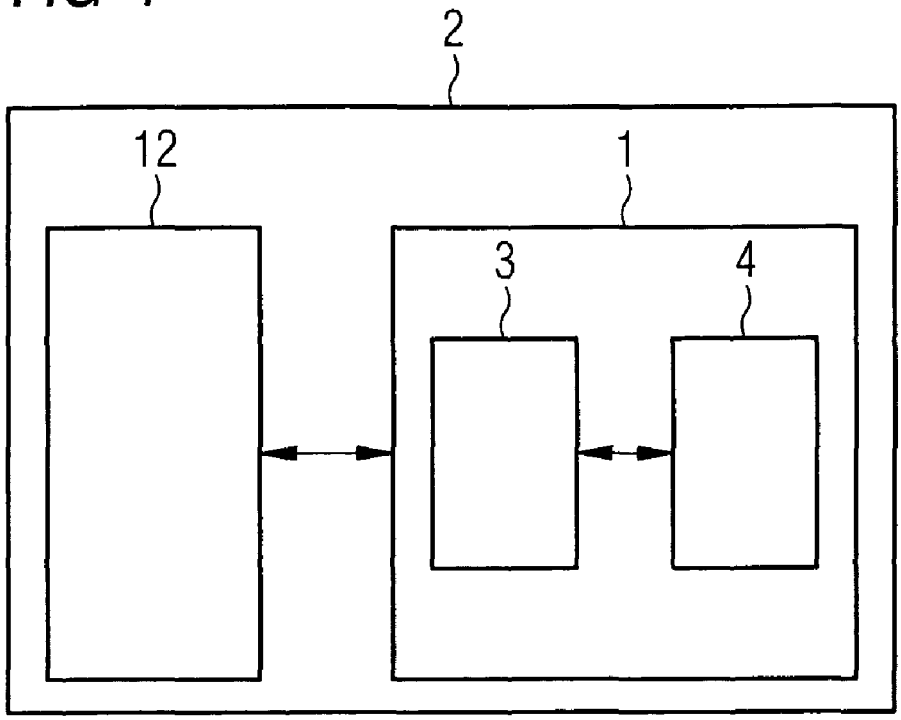
FIG. 4 shows a block diagram of a hearing device with a connected unit.

FIG. 4 shows a block diagram of a behind-the-ear part 6 with a base module 12. The unit 1, for instance an electroacoustic converter, includes a random access memory 3 and a sequence control element 4. The electroacoustic converter 1 may be a receiver or a microphone. The unit 1 is electrically connected to the base module 12 of the behind-the-ear part 6.

After switching on the hearing device 2, the base module 12 reads out the memory content of the converter 1 and thus inter alia receives information concerning the type, the serial number of the unit 1, special characteristics of the unit 1, frequency response and output sound pressure level. This data can be used for a hearing device setting. The base module 12 can also examine whether the correct type of a converter was connected or whether the converter is the correct one for the correct side of the head. Furthermore, it is possible to read out from the memory when and by whom the converter was manufactured and when the guarantee expires. In addition, original calibration settings can be read out in order to be able to draw conclusions relating to the drift and ageing processes of the hearing device 2 and the units 1.

With units 1 without a converter, data relating to the contained control elements or signal sources as well as preferred settings can be read out. These can also be stored in the random access memory 3 during an adjustment by means of a hearing device acoustician.

Data can be read out of the random access memory 3 once in a time-controlled fashion, for instance every complete hour, or in an event-controlled manner, for instance in the event of a program change, once the hearing device has been switched on.

Alternatively the unit 1 can trigger a transmission of data from the random access memory 3 when applying the supply voltage.

Figure 5:
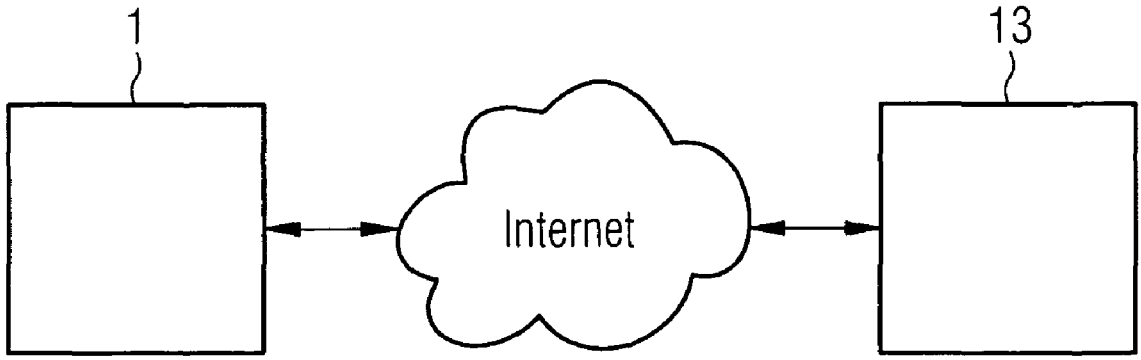
FIG. 5 shows a block diagram of a unit when connected to a service control center.

FIG. 5 shows a block diagram of a unit 1 which is connected to a service control center 13 by way of the internet. The service control center 13 can be established in the case of a hearing device acoustician or a manufacturer. As a result, data can be transmitted to the service control center 13 for service purposes, settings can be changed by the service control center 13 or new software or firmware loaded into the unit 1.

The invention claimed is:

1. A method for exchanging data between a hearing device and connectable units, comprising:

providing the hearing device;

selecting a unit;

connecting the selected unit to the hearing device;

detecting via the hearing device when a contact exists with the connected unit;

reading an identification code from a memory of the detected unit by the hearing device; and reading a further parameter stored on the selected unit by the hearing device, wherein a signal processing algorithm is activated on the selected unit by the hearing device based on the identification code and the further parameter.

2. The method as claimed in claim 1, wherein the parameter is read at a predetermined interval after detecting the contact.

3. The method as claimed in claim 1, wherein an operating parameter is activated on the selected unit by the hearing device based on the identification code and the further parameter.

4. The method as claimed in claim 1, further comprising:

outputting data to the selected unit by the hearing device.

5. The method as claimed in claim 4, wherein data output to the selected unit includes an operating parameter.

6. The method as claimed in claim 4, wherein data output to the selected unit include a signal processing algorithm.

7. A system for exchanging data between a hearing device and a connectable unit, comprising:

the hearing device;

the connectable unit comprises:

a contact spring, and a memory, a identification code and a further parameter, wherein the connectable unit is embodied such that the connectable unit transmits the identification code and the further parameter to the hearing device after a contact is established with the hearing device via the contact spring, wherein the hearing aid is adapted to activate a signal processing algorithm on the selected unit by the hearing device based on the identification code and the further parameter.

8. The arrangement as claimed in claim 7, with the memory includes random access memory.

9. The arrangement as claimed in claim 8, with the unit includes a sequence control element.

10. The arrangement as claimed in claim 7, with the unit includes an electroacoustic converter.

* * * * *